US010907804B2

(12) United States Patent
Chen et al.

(10) Patent No.: US 10,907,804 B2
(45) Date of Patent: Feb. 2, 2021

(54) LIGHTING APPARATUS

(71) Applicant: XIAMEN ECO LIGHTING CO. LTD., Xiamen (CN)

(72) Inventors: Huaye Chen, Xiamen (CN); Lingfeng Zhou, Xiamen (CN); Xianghua Lin, Xiamen (CN); Yong jun Bao, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/437,316

(22) Filed: Jun. 11, 2019

(65) Prior Publication Data

US 2020/0340645 A1 Oct. 29, 2020

(30) Foreign Application Priority Data

Apr. 28, 2019 (CN) ..... 2019 2 0595964 U

(51) Int. Cl.

| | |
|---|---|
| ***F21V 19/00*** | (2006.01) |
| ***F21V 17/12*** | (2006.01) |
| ***F21V 29/70*** | (2015.01) |
| ***H05B 45/30*** | (2020.01) |
| ***F21V 3/04*** | (2018.01) |
| *F21Y 115/10* | (2016.01) |

(52) U.S. Cl.

CPC ..... *F21V 17/12* (2013.01); *F21V 3/049* (2013.01); *F21V 29/70* (2015.01); *H05B 45/30* (2020.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 7,637,636 | B2 * | 12/2009 | Zheng | F21S 2/005 362/294 |
| 2013/0328493 | A1 * | 12/2013 | Munday | H05B 45/37 315/201 |
| 2015/0377452 | A1 * | 12/2015 | Walesa | B64D 47/04 362/240 |
| 2017/0311399 | A1 * | 10/2017 | Shah | F21V 23/009 |

* cited by examiner

*Primary Examiner* — Elmito Breval

(74) *Attorney, Agent, or Firm* — Chun-Ming Shih; Lanway IPR Services

(57) ABSTRACT

A lighting apparatus includes a cap head, a light source, a driver and a light module. The cap head has a cap housing. The light module has a light housing, a first end and a second end. The first end and the second end are located at two opposite sides of the light housing. The light source is disposed in the light housing. One of the first end and the second end is selected and detachably connected to the cap head.

20 Claims, 8 Drawing Sheets

LIGHTING APPARATUS

FIELD

The present invention is related to a lighting apparatus and more particularly related to a lighting apparatus that provide multiple operating modes.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures, and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

According to an embodiment, a lighting apparatus includes a cap head, a light source, a driver, a light module and a light module.

The cap head has a cap housing. The cap housing is deigned to be inserted to a power socket to receive an external power, e.g. 110V AC power, from an external power source. For example, the cap housing is an Edison cap for inserting into a corresponding Edison socket so as to receive electricity from an indoor power connection.

The light source may include one or more luminance devices like LED modules. The driver is used for converting the external power to a driving current supplied to the light source.

The light module has a light housing, a first end and a second end. The first end and the second end are located at two opposite sides of the light housing.

The light source is disposed in the light housing. One of the first end and the second end is selected and detachably connected to the cap head. A light effect of the lighting apparatus is different between when the first end is connected to the cap head and when the second end is connected to the cap head.

The light effect includes a main light direction, color temperature, color, luminance level, other optical characteristics and/or their combinations.

Usually, a light source has a main light direction, e.g. 80% of the light distributes within 120 degrees of a light source plate. For example, a row of LED modules are mounted on a plate. Each LED module emits light upward and 80% of light is distributed within 120 degrees of the central vertical line of each LED module. In such case, there is some light outside 120 degrees of the light source plate, but most light is kept within a range, which defines a main light direction.

For example, a main light direction is directed to ground so as not to emit undesired light to influence neighbor's house when the first end of the light module is attached to the cap head. By reverse the light module and connecting the second end to the cap head, the main light direction is now directed upward, providing a different light effect for some other situation, e.g. a holiday BBQ in back yard.

In other words, a user may select the first end to be connected to the cap head for daily use and detach the light module and reverse the light module for the second end to be connected to the cap head for holiday use.

The same light module, by reversing it connection, therefore provides at least two different modes to be used for different purposes conveniently.

In some embodiments, a main light direction of the light module faces downward when the first end is connected to the cap head and the main light direction of the light module faces upward when the second end is connected to the cap head.

In such case, the light module emits light with a tilt angle with respect to a central axis of the cap head. Therefore, when the light module is attached to a cap head with the first end, the main light direction is toward the ground. When the light module is attached to the cap head with the second end, the main light direction is toward the sky, for another purpose.

The light source includes multiple LED modules mounted on a light source plate kept a tilt angle with respect to a central axis of the cap head.

The light source plate may be a cone shape, thus keeping a tilt angle with respect to the central axis of the cap head. In some other embodiments, the light source plate may have multiple parts assembled with clip structures to for a three dimensional polygonal structure for mounting LED modules.

In some embodiments, the light source plate is a cone shape structure.

In some embodiments, there is a heat sink attached at an opposite side of the light source plate. The heat sink and the LED modules are placed at opposite sides of the light source plate. The heat sink may include metal piece for efficiently dissipating heat generated by the LED modules.

In some embodiments, the light module is composed of multiple sub-modules. Each sub-module contains a part of the light source with a main light direction kept a tilt angle with respect to a central axis of the cap head.

In some embodiments, each sub-module has a plate unit, a LED module and a diffusion cover. Multiple sub-modules may be connected together with plugging structure forming a light module.

In some embodiments, the plate unit has multiple heat sink fins arranged in a trapezoid shape. In such design, there is a tilt angle for the LED modules while providing space for arranging the heat sink fins.

In some embodiments, the cap head has an Edison cap and a cap container, the cap container encloses the driver.

In some embodiments, the light source generates a first light when the first end is attached to the cap head and generates a second light when the second end is attached to the cap head. The first light and the second light have different optical characteristics. Specifically, by selecting the first end or the second end, a different working mode is selected. By detecting which of the first end or the second end is connected, the driver may provide different currents for providing different light effects, e.g. different color temperatures, colors.

The first end and the second end may correspond different wire routing so as for activating different settings of the light module.

In some embodiments, the light housing is concealed and has an exposed electrode for electrically connected to the external power source.

In some embodiments, the first end and the second end have the same screw structure for being attached to the cap head. For example, the first end and the second end have the same screw grooves corresponding to a screw structure disposed at the cap head. In such case, a user may select either the first end or the second end to attach to the cap head for desired light effect.

In some embodiments, there is a central column fixed to the cap head and the light module have a central tube for inserting the central column.

The central column may be a cylinder, a bar, or a structure with one end to be attached to the cap head and extended to another end to be attached to either the first end or the second end of the light module.

In some embodiments, there is a bottom cover attached to the central column for keeping the light housing between the cap head and the bottom cover. As mentioned above, the light module may be connected to the cap head with its first end or second end. While the light module is attached to the cap head with its first end, its second end is connected to the bottom cover.

In the case with a central column as mentioned above, the bottom cover and the cap head together with the central column hold the light module therebetween and keep the light module at a predetermined position.

In some embodiments, the bottom cover allows passing light out of the lighting apparatus. The bottom cover may have its own light source or permitting light emitted from the light source to be emitted via the bottom cover. The bottom cover may be a diffusion layer or a lens module for generating a light beam.

In some embodiments, the bottom cover has a manual switch for operating the light source. For example, the bottom cover includes a button to be pressed to indicate the driver to turn on, turn off, switch to a desired working mode of the light module. The bottom cover is placed at the bottom and convenient to be operated by a user, thus suitable for being used as a manual switch.

In some embodiments, the central column has at least one conductive path for routing the driving current. As mentioned above, the light housing of the light module may be concealed for safety or other reason, while electrodes are reserved so as to conduct electricity into the light source of the light module.

In other words, electricity is routed from the cap head and enters the conductive path into the light module. In some embodiments, the driver is located inside the light module. In such case, the conductive path routes external power into the driver via the conductive path. In other case, the driver is placed outside the light module. The driving current generated by the driver is routed to the light source of the light module via the conductive path.

The central column has two conductive paths respectively used for connecting the first end to the cap head and for connecting the second end to the cap head. When the first end is connected to the cap head, a first conductive path is activated for routing electricity and/or signals. When the second end is connected to the cap head, a second conductive path is activated for routing electricity and/or signals.

The light module is replaceable with another light module having the same first end and the second end for providing another optical output. In other words, a light module with different features, e.g. light sources with different optical feature, housing shapes, light directions, may be replaced with a previous light module.

In other words, users may buy several different light modules for different purposes while using the same light base.

In some embodiments, the light module is operable when detached from the cap head.

DETAILED DESCRIPTION

According to an embodiment, a lighting apparatus includes a cap head, a light source, a driver, a light module and a light module.

Figure 1:
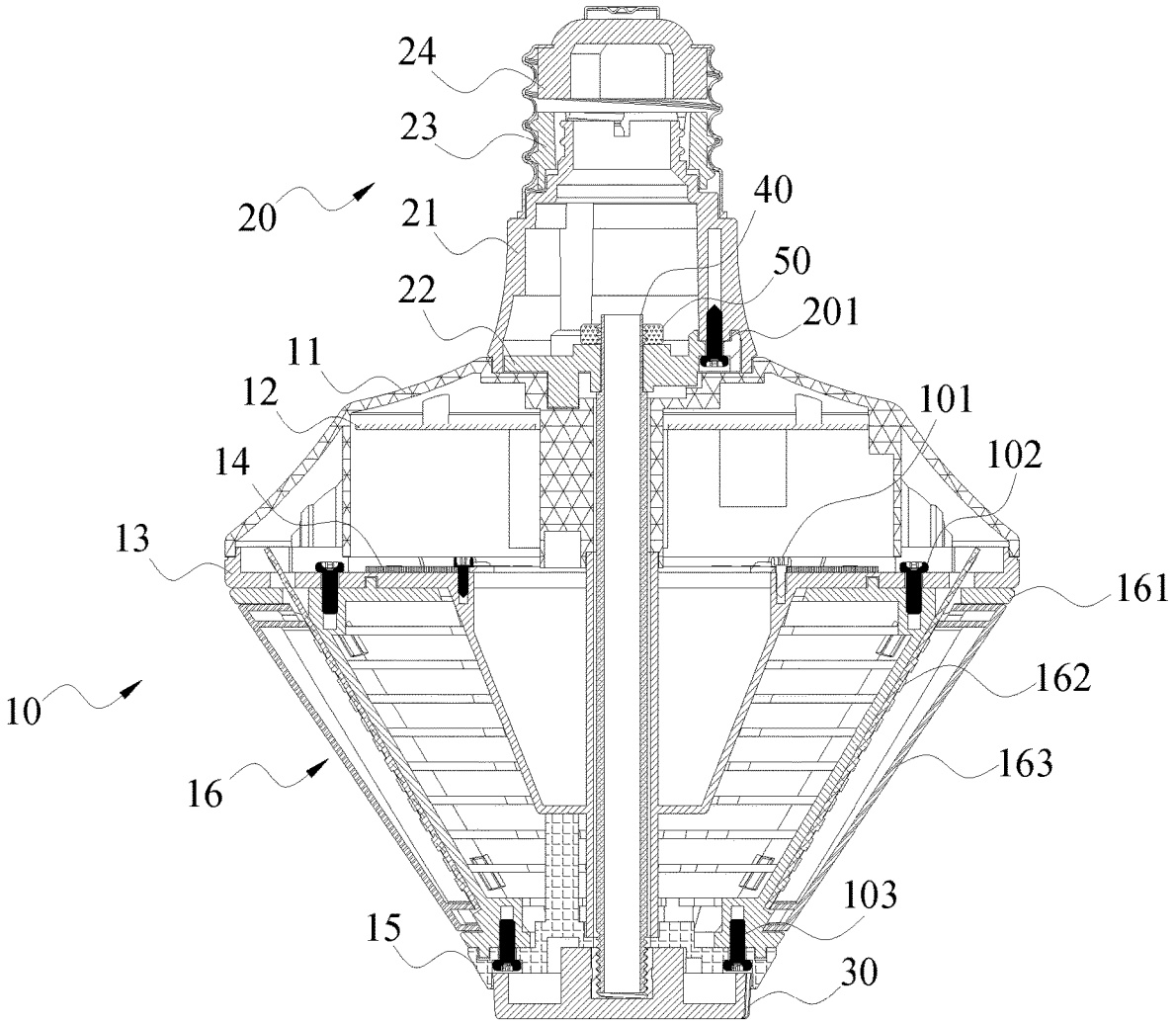
FIG. 1 is a cross-sectional view of an embodiment of a lighting apparatus.
Figure 2:
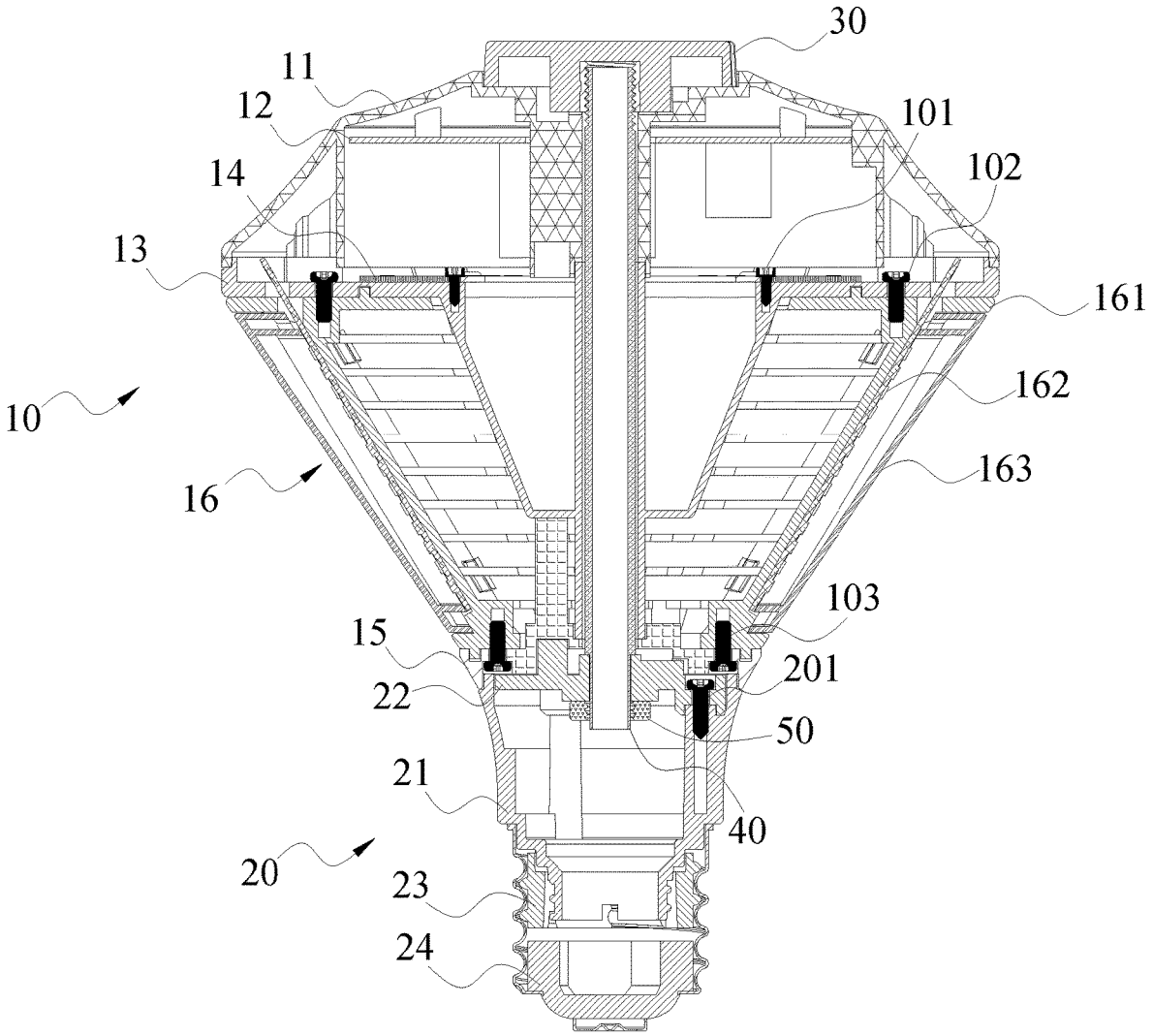
FIG. 2 is a second mode of the embodiment of FIG. 1.
Figure 3:
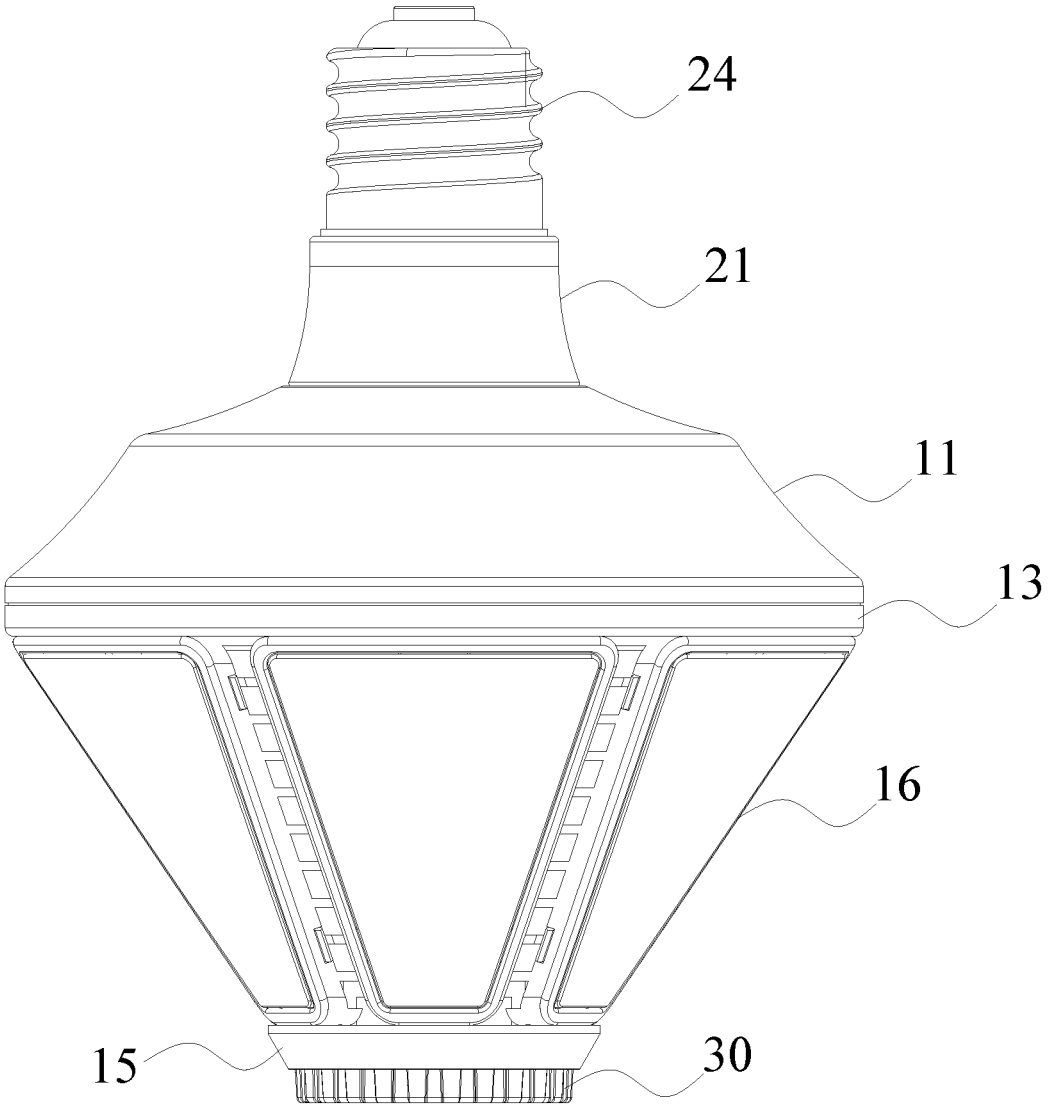
FIG. 3 shows a side view of the embodiment of FIG. 1.
Figure 4:
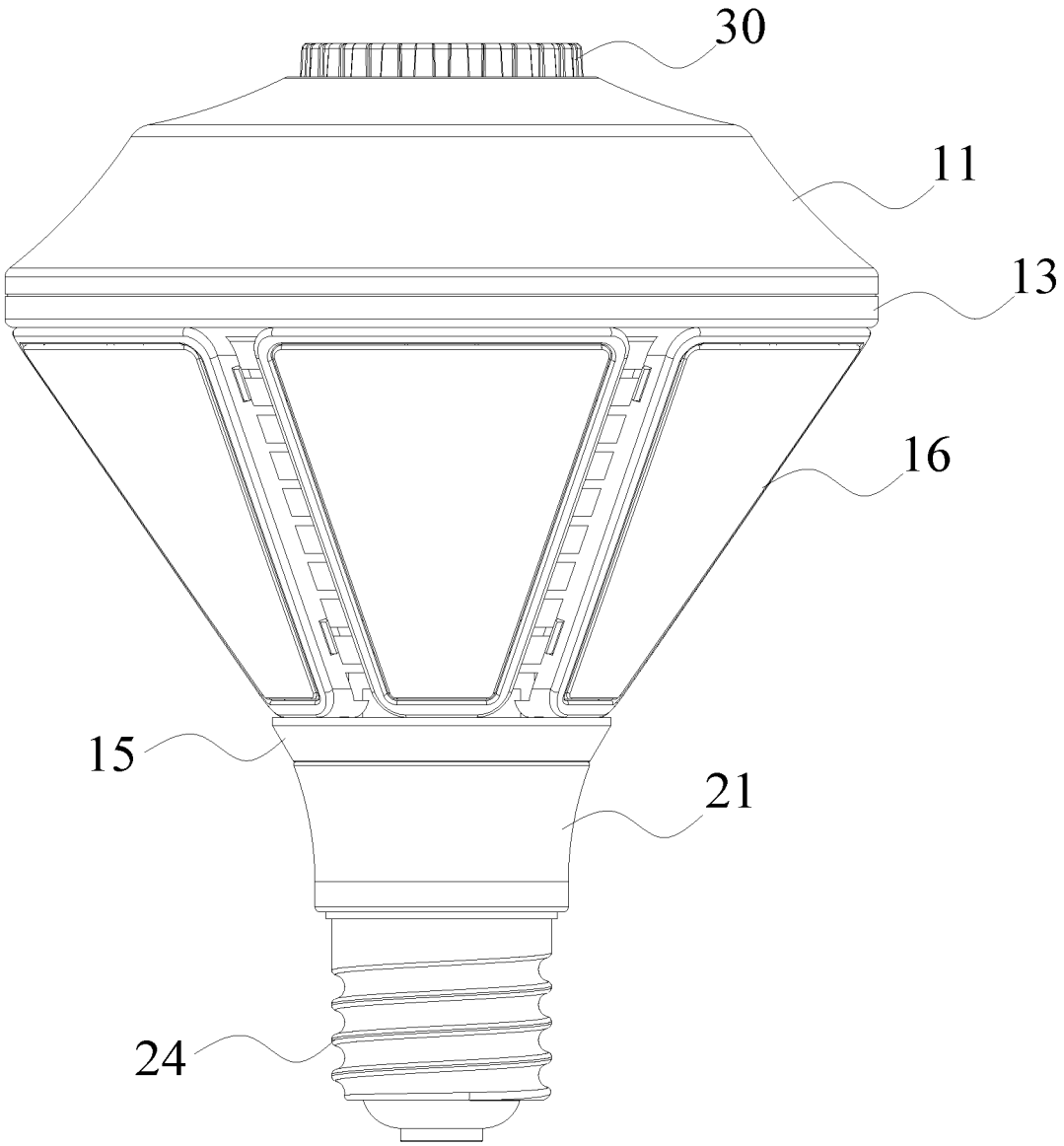
FIG. 4 shows a second mode of the embodiment of FIG. 1

Please refer to FIG. 1 to FIG. 8. FIG. 1 is a cross-sectional view of an embodiment of a lighting apparatus. FIG. 2 is a second mode of the embodiment of FIG. 1. FIG. 3 shows a side view of the embodiment of FIG. 1. FIG. 4 shows a second mode of the embodiment of FIG. 1

Figure 5:
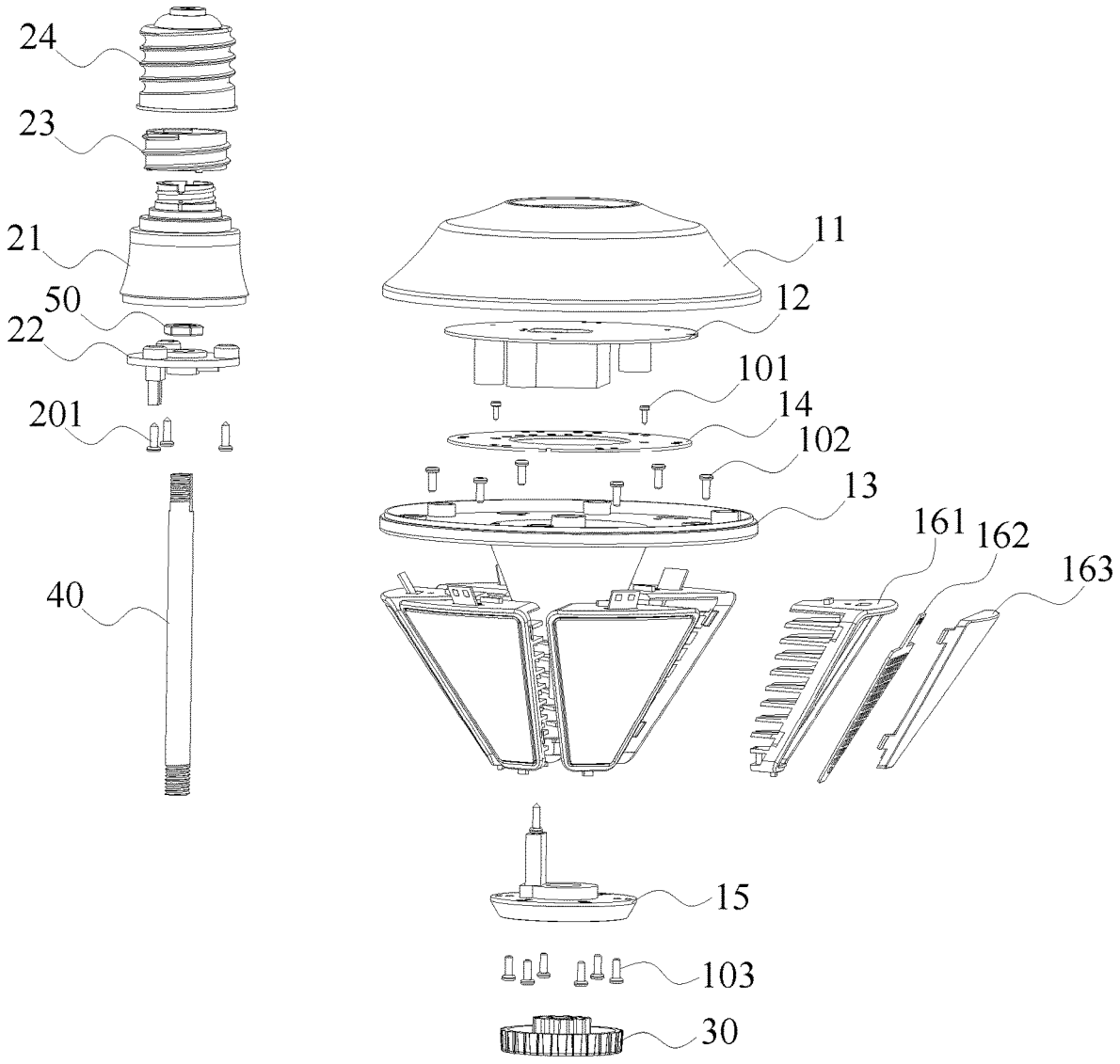
FIG. 5 is an exploded view of the embodiment of FIG. 1.
Figure 6:
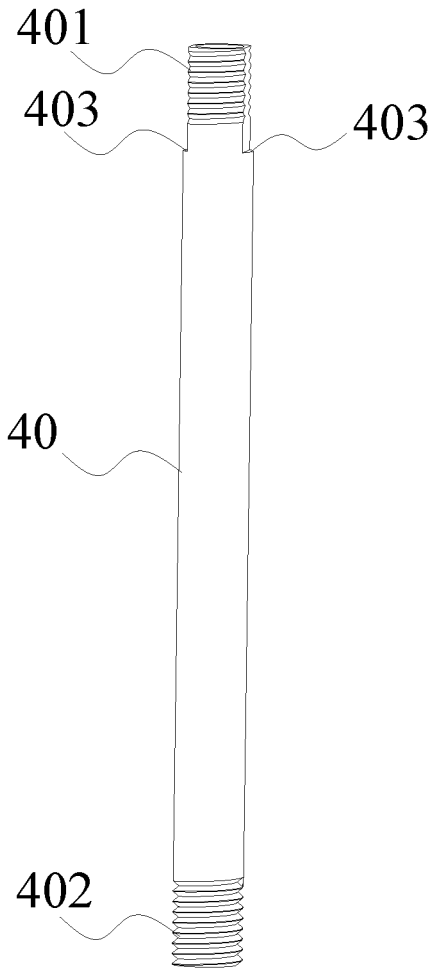
FIG. 6 shows an example of a central column.
Figure 7:
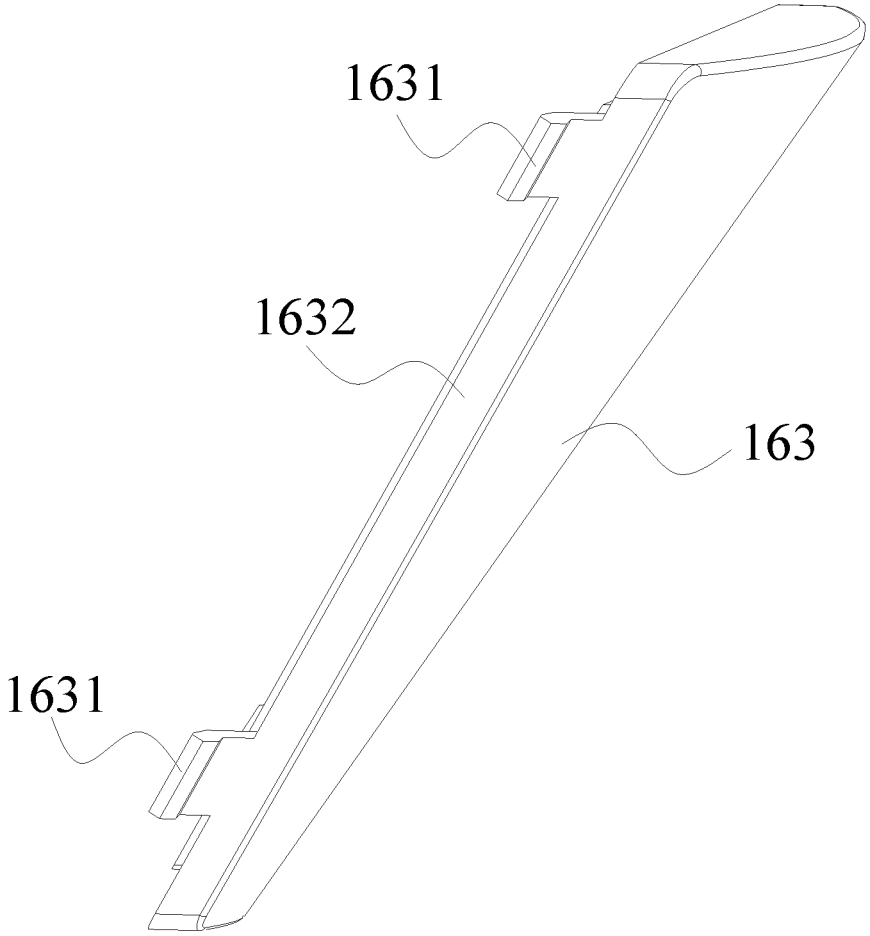
FIG. 7 shows a component of a light module.
Figure 8:
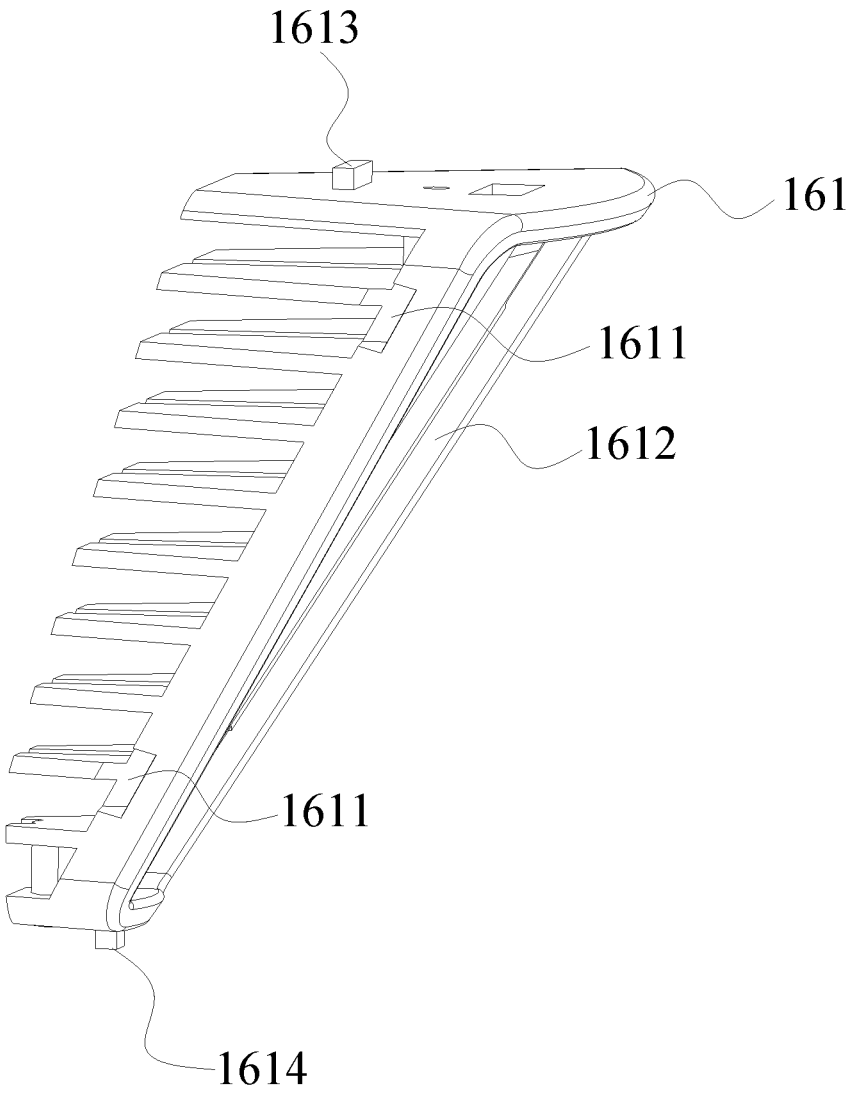
FIG. 8 shows another component of a light module.

FIG. 5 is an exploded view of the embodiment of FIG. 1. FIG. 6 shows an example of a central column. FIG. 7 shows a component of a light module. FIG. 8 shows another component of a light module. Reference numerals in these figures refer to the same components.

The cap head 20 has a cap housing. The cap housing is deigned to be inserted to a power socket to receive an external power, e.g. 110V AC power, from an external power source. For example, the cap housing is an Edison cap 24 for inserting into a corresponding Edison socket so as to receive electricity from an indoor power connection.

The light source may include one or more luminance devices like LED modules. The driver is used for converting the external power to a driving current supplied to the light source.

The light module 16 has a light housing, a first end and a second end. The first end and the second end are located at two opposite sides of the light housing.

The light source is disposed in the light housing. One of the first end and the second end is selected and detachably connected to the cap head. A light effect of the lighting apparatus is different between when the first end is connected to the cap head 20 and when the second end is connected to the cap head 20.

FIG. 1 and FIG. 3 show the first mode. FIG. 2 and FIG. 4 show the second mode.

The light effect includes a main light direction, color temperature, color, luminance level, other optical characteristics and/or their combinations.

Usually, a light source has a main light direction, e.g. 80% of the light distributes within 120 degrees of a light source plate. For example, a row of LED modules is mounted on a plate. Each LED module emits light upward and 80% of light is distributed within 120 degrees of the central vertical line of each LED module. In such case, there is some light outside 120 degrees of the light source plate, but most light is kept within a range, which defines a main light direction.

For example, a main light direction is directed to ground so as not to emit undesired light to influence neighbor's house when the first end of the light module is attached to the cap head. By reverse the light module and connecting the second end to the cap head, the main light direction is now directed upward, providing a different light effect for some other situation, e.g. a holiday BBQ in back yard.

The lighting apparatus includes a cap head 20, a bottom cover 30, a light module 10, and a central column 40. The light module 10 has a cone luminance surface. The light module 10 has a central tube for inserting the central column 40.

There is a limiting ladder 403 outside the central column 40. There is a corresponding protruding structure associated to the limiting ladder 403 so that the when the central column 40 is connected to the screw 50, the central column 40 is fixed at a predetermined position.

In addition, there are two screw grooves 401, 402 at two ends of the central column 401.

The bottom cover 30 has corresponding screw structures for attaching to the screw groove 402.

The light module 20 includes a light head base 20, a bracket 22, an inner housing 23 and a light head 24.

The light head base 21 has a hollow structure. The bracket 22 is fixed to one end of the light head base 21. The inner housing 23 is fixed to one end of the light head base 21. The light head 24 is attached and kept outside the inner housing 23.

The bracket 22 is attached to the light head base 21 with a first fastener 201.

The central column 40 has the screw groove 401 with one end connected to the screw structure 50.

The light module 10 includes a driver box 11, a power source 12, a top cover 13, a printed circuit board 14, a bottom cover 15 and a light source 16.

A driver 12 is placed in the driver box 11 for providing a driving current.

The light source 16 may include multiple heat sinks 161, multiple light source plates 162 and multiple diffusion cover 163.

In FIG. 7 and FIG. 8, there are two positioning structures 1613 and 1614 for positioning these sub-modules to form the light module. For example, there are multiple corresponding clips 1631 for assembling the light module. The rubber bands 1632 may be used for water proof function.

In other words, a user may select the first end to be connected to the cap head for daily use and detach the light module and reverse the light module for the second end to be connected to the cap head for holiday use.

The same light module, by reversing it connection, therefore provides at least two different modes to be used for different purposes conveniently.

In some embodiments, a main light direction of the light module faces downward when the first end is connected to the cap head and the main light direction of the light module faces upward when the second end is connected to the cap head.

In such case, the light module emits light with a tilt angle with respect to a central axis of the cap head. Therefore, when the light module is attached to a cap head with the first end, the main light direction is toward the ground. When the light module is attached to the cap head with the second end, the main light direction is toward the sky, for another purpose.

The light source includes multiple LED modules mounted on a light source plate kept a tilt angle with respect to a central axis of the cap head.

The light source plate may be a cone shape, thus keeping a tilt angle with respect to the central axis of the cap head. In some other embodiments, the light source plate may have multiple parts assembled with clip structures to for a three dimensional polygonal structure for mounting LED modules.

In some embodiments, the light source plate is a cone shape structure.

In some embodiments, there is a heat sink attached at an opposite side of the light source plate. The heat sink and the LED modules are placed at opposite sides of the light source plate. The heat sink may include metal piece for efficiently dissipating heat generated by the LED modules.

In some embodiments, the light module is composed of multiple sub-modules. Each sub-module contains a part of the light source with a main light direction kept a tilt angle with respect to a central axis of the cap head.

In some embodiments, each sub-module has a plate unit, a LED module and a diffusion cover. Multiple sub-modules may be connected together with plugging structure forming a light module.

In some embodiments, the plate unit has multiple heat sink fins arranged in a trapezoid shape. In such design, there is a tilt angle for the LED modules while providing space for arranging the heat sink fins.

In some embodiments, the cap head has an Edison cap and a cap container, the cap container encloses the driver.

In some embodiments, the light source generates a first light when the first end is attached to the cap head and generates a second light when the second end is attached to the cap head. The first light and the second light have different optical characteristics. Specifically, by selecting the first end or the second end, a different working mode is selected. By detecting which of the first end or the second end is connected, the driver may provide different currents for providing different light effects, e.g. different color temperatures, colors.

The first end and the second end may correspond different wire routing so as for activating different settings of the light module.

In some embodiments, the light housing is concealed and has an exposed electrode for electrically connected to the external power source.

In some embodiments, the first end and the second end have the same screw structure for being attached to the cap head. For example, the first end and the second end have the same screw grooves corresponding to a screw structure disposed at the cap head. In such case, a user may select either the first end or the second end to attach to the cap head for desired light effect.

In some embodiments, there is a central column fixed to the cap head and the light module have a central tube for inserting the central column.

The central column may be a cylinder, a bar, or a structure with one end to be attached to the cap head and extended to another end to be attached to either the first end or the second end of the light module.

In some embodiments, there is a bottom cover attached to the central column for keeping the light housing between the cap head and the bottom cover. As mentioned above, the light module may be connected to the cap head with its first end or second end. While the light module is attached to the cap head with its first end, its second end is connected to the bottom cover.

In the case with a central column as mentioned above, the bottom cover and the cap head together with the central column hold the light module therebetween and keep the light module at a predetermined position.

In some embodiments, the bottom cover allows passing light out of the lighting apparatus. The bottom cover may have its own light source or permitting light emitted from the light source to be emitted via the bottom cover. The bottom cover may be a diffusion layer or a lens module for generating a light beam.

In some embodiments, the bottom cover has a manual switch for operating the light source. For example, the bottom cover includes a button to be pressed to indicate the driver to turn on, turn off, switch to a desired working mode of the light module. The bottom cover is placed at the bottom and convenient to be operated by a user, thus suitable for being used as a manual switch.

In some embodiments, the central column has at least one conductive path for routing the driving current. As mentioned above, the light housing of the light module may be concealed for safety or other reason, while electrodes are reserved so as to conduct electricity into the light source of the light module.

In other words, electricity is routed from the cap head and enters the conductive path into the light module. In some embodiments, the driver is located inside the light module. In such case, the conductive path routes external power into the driver via the conductive path. In other case, the driver is placed outside the light module. The driving current generated by the driver is routed to the light source of the light module via the conductive path.

The central column has two conductive paths respectively used for connecting the first end to the cap head and for connecting the second end to the cap head. When the first end is connected to the cap head, a first conductive path is activated for routing electricity and/or signals. When the second end is connected to the cap head, a second conductive path is activated for routing electricity and/or signals.

The light module is replaceable with another light module having the same first end and the second end for providing another optical output. In other words, a light module with different features, e.g. light sources with different optical feature, housing shapes, light directions, may be replaced with a previous light module.

In other words, users may buy several different light modules for different purposes while using the same light base.

In some embodiments, the light module is operable when detached from the cap head. For example, the light module may contain a battery that is charged when connected to the cap head. When the light module is detached from the cap head, the light module may be powered by the battery. When such light is used in a back yard as a lighting for garage, sometimes, the light module may be detached for temporary use, e.g. a BBQ party.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a cap head with a cap housing for being inserted into a power socket to receive an external power from an external power source;

a light source;

a driver for converting the external power to a driving current supplied to the light source;

a light module having a light housing, a first end and a second end, the first end and the second end being located at two opposite sides of the light housing, the light source being disposed in the light housing, one of the first end and the second end being selected and detachably connected to the cap head, a light effect of the lighting apparatus being different when the first end being connected to the cap head and the second end being connected to the cap head.

2. The lighting apparatus of claim 1, wherein a main light direction of the light module faces downward when the first end is connected to the cap head and the main light direction of the light module faces upward when the second end is connected to the cap head.

3. The lighting apparatus of claim 2, wherein the light source comprises multiple LED modules mounted on a light source plate kept a tilt angle with respect to a central axis of the cap head.

4. The lighting apparatus of claim 3, wherein the light source plate is a cone shape structure.

5. The lighting apparatus of claim 3, wherein there is a heat sink attached at an opposite side of the light source plate.

6. The lighting apparatus of claim 2, wherein the light module is composed of multiple sub-modules, each sub-module contains a part of the light source with a main light direction kept a tilt angle with respect to a central axis of the cap head.

7. The lighting apparatus of claim 6, wherein each sub-module has a plate unit, a LED module and a diffusion cover.

8. The lighting apparatus of claim 7, wherein the plate unit has multiple heat sink fins arranged in a trapezoid shape.

9. The lighting apparatus of claim 1, wherein the cap head has an Edison cap and a cap container, the cap container encloses the driver.

10. The lighting apparatus of claim 1, wherein the light source generates a first light when the first end is attached to the cap head and generates a second light when the second end is attached to the cap head, the first light and the second light have different optical characteristics.

11. The lighting apparatus of claim 1, wherein the light housing is concealed and has an exposed electrode for electrically connected to the external power rce.

12. The lighting apparatus of claim 1, wherein the first end and the second end have the same screw structure for being attached to the cap head.

13. The lighting apparatus of claim 1, further comprising a central column, wherein the central column is fixed to the cap head and the light module have a central tube for inserting the central column.

14. The lighting apparatus of claim 13, further comprising a bottom cover attaching to the central column for keeping the light housing between the cap head and the bottom cover.

15. The lighting apparatus of claim 14, wherein the bottom cover allows passing light out of the lighting apparatus.

16. The lighting apparatus of claim 14, wherein the bottom cover has a manual switch for operating the light source.

17. The lighting apparatus of claim 13, wherein the central column has at least one conductive path for routing the driving current.

18. The lighting apparatus of claim 17, wherein the central column has two conductive paths respectively used for connecting the first end to the cap head and for connecting the second end to the cap head.

19. The lighting apparatus of claim 1, wherein the light module is replaceable with another light module having the same first end and the second end for providing another optical output.

20. The lighting apparatus of claim 1, wherein the light module is operable when detached from the cap head.

* * * * *